US009367971B2

(12) United States Patent
Saugnac et al.

(10) Patent No.: US 9,367,971 B2
(45) Date of Patent: Jun. 14, 2016

(54) AIRCRAFT MAINTENANCE METHOD AND DEVICE

(75) Inventors: Frederic Saugnac, Toulouse (FR); Christian Fremont, Balma (FR)

(73) Assignee: AIRBUS, Blagnac (FR)

( * ) Notice: Subject to any disclaimer, the term of this patent is extended or adjusted under 35 U.S.C. 154(b) by 1269 days.

(21) Appl. No.: 12/594,653

(22) PCT Filed: Apr. 4, 2008

(86) PCT No.: PCT/FR2008/000476

§ 371 (c)(1),
(2), (4) Date: Oct. 5, 2009

(87) PCT Pub. No.: WO2008/139061

PCT Pub. Date: Nov. 20, 2008

(65) Prior Publication Data

US 2010/0131149 A1 May 27, 2010

(30) Foreign Application Priority Data

Apr. 6, 2007 (FR) ..... 07 54395

(51) Int. Cl.
*G07C 5/08* (2006.01)
*G07C 5/00* (2006.01)
*G08G 5/00* (2006.01)

(52) U.S. Cl.
CPC ..... *G07C 5/0808* (2013.01); *G07C 5/008* (2013.01); *G08G 5/0013* (2013.01)

(58) Field of Classification Search
CPC ..... G07C 5/008; G07C 5/0808; G08G 5/0013
USPC ..... 701/3, 29.1, 29.6, 29.7, 29.8, 31.4, 31.5
See application file for complete search history.

(56) References Cited

U.S. PATENT DOCUMENTS 5,931,877 A * 8/1999 Smith ..... B64D 7/00 701/31.5
5,974,349 A * 10/1999 Levine ..... B64F 5/00 340/945
2003/0003872 A1 1/2003 Brinkley et al.
(Continued)

FOREIGN PATENT DOCUMENTS

WO 2007 064655 6/2007

OTHER PUBLICATIONS

Cisco; Cisco Secure Access Control Server for Windows, EAP-TPS Deployment Guide for Wireless LAN Networks; Dec. 5, 2004 version of http://www.cisco.com/en/US/products/sw/secursw/ps2086/products_white_paper09186a008009256b.shtml as per waybachmachine at http://archive.org/.*
(Continued)

*Primary Examiner* — Stephen Holwerda
(74) *Attorney, Agent, or Firm* — Oblon, McClelland, Maier & Neustadt, L.L.P

(57) ABSTRACT

A method for the maintenance of an aircraft including an avionics system including a set of operating units. The avionics system is connected to a ground-based infrastructure via at least one communication medium. Maintenance data stored in the ground-based infrastructure and relating to the malfunction of at least one operating unit are obtained via the at least one communication medium, and at least one operating unit is repaired on the basis of the maintenance data obtained.

21 Claims, 7 Drawing Sheets

(56) References Cited

U.S. PATENT DOCUMENTS

2003/0120501 A1 6/2003 Peters et al.
2004/0056766 A1* 3/2004 Butz ..... F02C 9/00 340/539.1
2004/0162651 A1* 8/2004 Halm ..... B64D 47/00 701/29.4
2005/0026609 A1 2/2005 Brinkley et al.
2005/0108374 A1* 5/2005 Pierzga ..... H04B 7/18504 709/223
2005/0149238 A1* 7/2005 Stefani ..... G01D 9/005 701/33.4
2005/0256616 A1* 11/2005 Rhoads ..... H04L 67/06 701/1
2006/0293803 A1* 12/2006 Pomies ..... G07C 5/006 701/3
2007/0127460 A1 6/2007 Wilber et al.

OTHER PUBLICATIONS

Cisco; Cisco Secure Access Control Server for Windows, EAP-TPS Deployment Guide for Wireless LAN Networks; Dec. 5, 2004; see attached web.archive.org printout.*

* cited by examiner

AIRCRAFT MAINTENANCE METHOD AND DEVICE

BACKGROUND OF THE INVENTION

This invention relates to a method and device for maintenance in an aircraft.

Nowadays an avionic system comprises a set of on-board tools and databases so as, in particular, to computerize the tools, in particular the tools for diagnosis, for maintenance, and documents, such as the manuals for diagnosis of breakdowns or operating manuals for the airplane. The tools therefore now are used, for example, by software or databases.

Mainly, two types of maintenance can be considered.

First, there is considered the maintenance that takes place in the main maintenance base for the airplane or outside this base, consisting in actions limited to adjustment, safety and the need to have the airplane fly, also called dispatch, without delay or within a limited delay.

Then there is considered the maintenance performed in the main maintenance base for the airplane for which additional maintenance actions are performed, such as the maintenance taking place at regular intervals.

In FIG. 1 there is illustrated a diagram of maintenance operations performed in the airplane and in the maintenance base on the ground according to a known solution.

Maintenance is backed by a system, in particular a central maintenance computer 100 ("Central Maintenance Computer" in English terminology), that collects, consolidates and reports faults in the replaceable entities of the airplane LRU 105 ("Line Replaceable Unit" in English terminology) in order to help the flight crew and the maintenance personnel in the maintenance procedures.

Faults in the replaceable entities of the airplane 105 are the object of alarm management by a computer 110.

The central maintenance computer 100 sends out a maintenance message 115 to the company to which the airplane is attached, in particular to the maintenance control center MCC (acronym for "Maintenance Control Center" in English terminology).

A screen 120 is connected to the alarm management computer 110 in order to display the faults in the replaceable entities of the airplane 105.

The set of faults or events occurring during a service of the airplane is stored in an on-board notebook 125 called "logbook" in English terminology. This logbook linked to the airplane is filled out either by the pilots ("technical logbook" in English terminology) or by the cabin crew ("Cabin Logbook" in English terminology).

To do so, the crew manually enters in the logbook 125 the faults that occurred as well as the flight conditions under which the faults occurred.

When the airplane is on the ground, the logbook is retrieved 130 in the airplane in order to be read on the ground by the maintenance control center MCC 135. Then a maintenance technician goes into the airplane in order to analyze the faults recorded and make a diagnosis 140.

The technician then goes to the maintenance base on the ground in order to obtain the procedure for isolation of the fault 145.

With this procedure, also called TSM (acronym for "Troubleshooting manual" in English terminology), the technician again goes into the airplane in order to carry out this procedure for isolation of faults 150.

At the end of isolation of faults, the technician returns to the base on the ground in order to obtain the repair procedure 155 and if need be to order a replacement part from the spares warehouse.

Then the maintenance technician once again goes back into the airplane to carry out the repair procedure 160.

Then tests 165 are performed in order to check functioning at the end of the repair and an acceptance procedure 170 is carried out, consisting in declaring the airplane as being able to fly.

Finally, this acceptance is entered in the logbook 175.

As will be easily understood upon reading of the foregoing, this maintenance operating mode has a high cost, and grounds the airplane for a considerable time.

Another known solution consists in storing in the storage mediums on board (databases) the set of procedures for isolation of faults and the set of procedures for repair making it possible to do away with the maintenance technician's back-and-forth between the airplane and the maintenance base on the ground.

The set of procedures for isolation of faults and the set of procedures for repair, however, represent a large volume of data, capable of reaching several gigabytes of data.

The set of tools, data and documents furthermore must be regularly updated so that the crew of the airplane, and more particularly the pilot and the maintenance technician, can benefit from the most recent version of the tools and documents.

To do so, the tools and documentation are loaded into the computer or computers of the airplane by a technician in charge of keeping these tools and documents up to date (or synchronizing the on-board databases with the databases on the ground). He is equipped, for example, with a portable computer comprising in storage the most recent version of the tools and data, and goes into the airplane in order to perform the loading and updating of the tools and data.

However, given that these tools and the documentation represent a large volume of data, namely several gigabytes, this updating is lengthy and can necessitate grounding the airplane for a relatively long time.

The same is true if the technician uses a portable computer having a Wifi radio connection with which he loads the data and he updates the tools and data stored in the network of the airplane from the data loaded onto his portable computer.

Moreover, an airline company usually has a large fleet of airplanes which translates into a high cost for maintenance of the tools and documents of the airplanes in its fleet as well as an extensive configuration management of the data on the ground intended to be loaded on board the airplanes.

Keeping such a volume up to date thus is made difficult. As a result of that, the maintenance technician, relying on these procedures stored in the airplane, may obtain information items concerning the procedures for isolation and repair to be followed which no longer may be up to date, or even be erroneous. Furthermore, when the data for resolution of problems are on board, that does not avoid the need for the maintenance technician to make contact with the spare parts warehouse.

SUMMARY OF THE INVENTION

This invention has as its object to remedy at least one of the drawbacks of the techniques and processes of the aforesaid prior art. To do so, the invention proposes a method for maintenance in an aircraft, making possible in particular the reduction of maintenance costs, the rapid return of the aircraft to operation, the updating of the data and tools of the aircraft in a secured manner without necessitating the intervention of a technician.

The invention thus has as its object a method for maintenance in an aircraft, the aircraft comprising an avionic system, the avionic system comprising a set of functional entities.

According to the invention, the avionic system is connected to an infrastructure on the ground according to at least one communication medium, and the method comprises:

- a step of consulting, via the at least one communication medium, maintenance data stored in the infrastructure on the ground relating to the malfunction of at least one functional entity,
- at least one step of obtaining data relating to the malfunction of at least one functional entity, and
- a step of repairing the at least one functional entity based on the maintenance data obtained.

The invention provides a method for maintenance in an aircraft with a view to minimizing maintenance cost, in particular by limiting the maintenance technician's back-and-forth between the aircraft and the infrastructure on the ground and by improving access to the information items relevant for the operations of maintenance of the entirety of the aircraft.

To do so, the avionic system is connected to the infrastructure on the ground via at least one communication medium, for example a mobile telephony network, a wireless communication network, a satellite network.

The maintenance procedure relies on such a communication medium in order to consult the maintenance data stored in the infrastructure on the ground and to obtain maintenance data, in particular the procedures for isolation and repair of malfunctioning functional entities so as to benefit from the current versions of these procedures.

In this way, the ground/on-board coordination of the maintenance tools is facilitated and the management of the databases stored in the aircraft is limited.

Furthermore, according to this method, the ground time of the aircraft for reasons of maintenance is minimized. The same is true for the intervention time of the maintenance technicians.

According to one particular characteristic, the method comprises a step of sending out at least one information item concerning malfunction of at least one functional entity to the infrastructure on the ground.

According to this characteristic, the method for maintenance is accelerated. As a matter of fact, the malfunctions of the airplane are sent out to the infrastructure on the ground so that the maintenance technicians will be informed, for example, prior to the landing of the airplane, of the faults occurring in the functional entities.

According to another characteristic, the method comprises a preliminary step of diagnosis of malfunction of at least one functional entity.

Thus, the method implemented in the aircraft makes it possible to recognize a malfunction or fault in at least one of the functional entities.

According to still another characteristic, the method comprises a step of isolating the malfunction based on the maintenance data obtained.

By virtue of this step, the cause of the malfunction in the functional entities is pointed out. Once the fault is isolated, repair of the fault can be undertaken.

According to a particular embodiment, the avionic system communicates with the infrastructure on the ground according to a synchronous communication mode.

According to this characteristic, it is permitted to carry out interactive browsing in the data stored in the infrastructure on the ground as well as in the documentary sites containing the airplane documentation (TSM or other) for example.

That is achieved by virtue of the permanent link that is established between the avionic system and the aircraft. In this way, the data stored in the infrastructure on the ground can be consulted and can be obtained from the aircraft, without need to establish a new connection each time it is wished to carry out one of the operations. Thus there exists a link dedicated to communication between the avionic system and the infrastructure on the ground.

As a matter of fact, at least one information-processing tool is shared between the infrastructure on the ground and the on-board avionic system. This tool makes it possible to carry out remote actions between the ground and on-board. It thus can be used by a sole operator set up at a fixed location.

By virtue of this shared tool, the maintenance operation and the simultaneous updating of the databases on the ground and on board can be accomplished in one go in synchronous manner, that is, in real time.

Thus there is no need for verification or an operation for synchronization of databases between the ground and on-board.

Furthermore, it is possible to follow the actions performed in the databases.

According to another embodiment, the method comprises a step of receiving a command for testing of at least one functional entity via the said at least one communication medium and a step of executing the said command on the said at least one functional entity.

According to this characteristic, it is possible to receive testing commands, in particular sent out by a maintenance technician on the ground using the infrastructure on the ground, so as to test the functional entities of the aircraft as early as possible, with a view, for example, to identifying malfunctions in functional entities of the aircraft.

According to one characteristic, the avionic system and the infrastructure on the ground are connected by a secured connection, in particular by a virtual private network.

Correlatively, the invention also applies to a device for maintenance in an aircraft, the aircraft comprising an avionic system, the avionic system comprising a set of functional entities, characterized in that, since the avionic system is connected to an infrastructure on the ground according to at least one communication medium, the device comprises:

- means for consulting, via the at least one communication medium, maintenance data stored in the infrastructure on the ground relating to the malfunction of at least one functional entity,
- means for obtaining data relating to the malfunction of at least one functional entity, and
- means for repairing the at least one functional entity based on the maintenance data obtained.

This device has the same advantages as the method for maintenance briefly described above.

Finally, this invention applies to a computer program comprising instructions adapted for the implementation of each of the steps of the method for maintenance such as set forth above.

BRIEF DESCRIPTION OF THE DRAWINGS

Other advantages, purposes and characteristics of this invention emerge from the detailed description that follows, given by way of non-limitative example, with reference to the attached drawings in which.

DETAILED DESCRIPTION OF THE INVENTION

In accordance with the invention, there is installed in the airplane an electronic maintenance system capable of performing maintenance operations in order in particular, to replace the paper process by an electronic process.

This system relies on an on-board infrastructure in an airplane, that is, an avionic system comprising in particular a set of functional entities of the airplane, for example replaceable entities of the airplane, accommodating applications for crew and maintenance, an infrastructure on the ground to prepare, personalize and manage the data to be used on board, for example to perform maintenance operations or to obtain data from the airplane to be used on the ground and a connection infrastructure for exchanging data between the infrastructure on the ground and the on-board infrastructure and for updating the tools and the data stored in the on-board infrastructure.

The infrastructure on the ground is, for example, present in the maintenance base of the airline company to which the airplane is attached.

Figure 2:
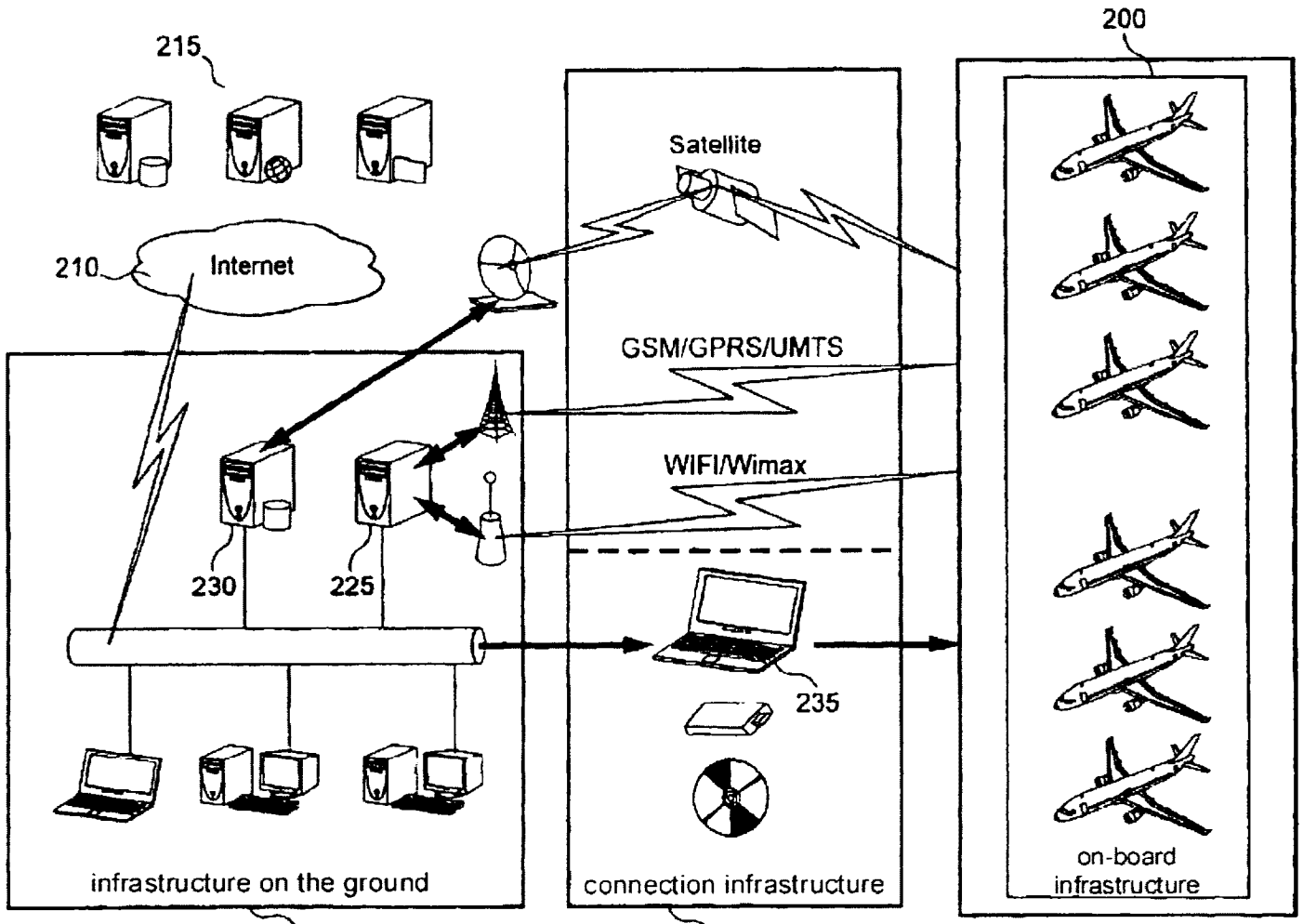
FIG. 2 illustrates an overall view of the system in which the invention is implemented.

FIG. 2 illustrates an overall view of the system used in the invention.

Thus, there is shown a group of airplanes 200 (on-board infrastructures) of an airline company and an infrastructure on the ground 205 of this company. This infrastructure on the ground comprises in particular a set of processing units interconnected via a telecommunication network. This network also comprises a connection 210, for example an Internet connection in order to be connected to the servers of the airplane manufacturers or to any third party 215.

The infrastructure on the ground also is connected via a communication network 220 (connection infrastructure) to the avionic network of the airplanes. The communication network 220 relies, for example, on a wireless communication medium, for example WIFI or Wimax, a mobile telephony communication medium, for example GSM/GPRS or UMTS or a satellite communication medium. Furthermore, the airplane can be connected to the ground by a hard-wired link in case of breakdown in the event of unavailability of the radio communication.

The network of the infrastructure on the ground thus comprises in particular a server 225 capable of sending out data to an airplane and receiving data from an airplane by satellite, and a server 230 capable of sending out data to an airplane and receiving data from an airplane by using a wireless communication or mobile telephony medium.

Furthermore, there may be used a portable medium 235, such as a portable computer, a USB ("Universal Serial Bus" in English terminology) key, a CD/DVD, in order to exchange data with the airplane.

Thus, in accordance with the invention, the infrastructure of the airplane is a mobile network capable of communicating with the infrastructure on the ground of the company of attachment so as to create a continuity between the on-board infrastructure and the infrastructure on the ground.

According to a particular embodiment, the on-board infrastructure communicates with the infrastructure on the ground according to a synchronous communication mode, this type of communication making it possible to do interactive browsing of the documentary sites containing the airplane documentation, for example.

Synchronous communication consists in establishing a link or channel for communication between the avionic system and the infrastructure on the ground, dedicated to communication between them, that is, it is available when, for example, one wishes to consult data in the infrastructure on the ground from the aircraft or one wishes to obtain information items stored in the infrastructure on the ground.

In this way, it is not necessary to establish a communication link or channel each time one wishes to conduct a communication.

Consequently, communication between the aircraft and the infrastructure on the ground is ensured so long as one is not dependent on whether or not a channel is available.

As the infrastructure of the airplane becomes a continuation of the infrastructure on the ground, it is possible to perform updates and maintenance operations in synchronous manner between the ground and on-board.

Moreover, communication can be initiated via the on-board infrastructure or via the infrastructure on the ground.

In accordance with the invention, the communication network 220 connecting the on-board infrastructure of an airplane and the infrastructure on the ground makes it possible no longer to take on board all the tools and software, but only the essential tools, the other data being able to be consulted by connection when that is necessary. In this way, a maintenance technician, in the airplane, can access the data stored in the infrastructure on the ground making it possible to perform maintenance operations, without going back and forth between the airplane and the maintenance base.

Furthermore, the maintenance technician, in the airplane, can perform updates of the tools and the data stored in the infrastructure of the airplane.

Furthermore, the maintenance technician can update the tools and the data in the airplane from the ground, an operation also called remote updating ("remote update" in English terminology). For example, the maintenance technician can update the status of the logbook of the airplane at the end of maintenance.

In the same way, the pilot or the maintenance operator can consult the ground servers in real time in order to have access to all the servers of the company to which the airplane is attached and simultaneously update the on-board data and tools, an operation also called remote operations ("remote operations" in English terminology).

Finally, a technician on the ground can command the performance of tests on the avionic system prior to the performance of maintenance operations by sending out commands via communication network 220. In this way, it is made possible for the maintenance technician, for example, prior to the landing of the airplane, to carry out tests with a view to identifying the replaceable entities of the malfunctioning airplane.

According to a particular embodiment, there is created, on a communication medium between the on-board infrastructure and the infrastructure on the ground, in particular on a wireless network or on a mobile telephony network, an encapsulation, also called tunneling ("tunneling" in English) protocol, capable of encapsulating the data to be transmitted in encoded form. This network created is called a virtual private network (designated as RPV or VPN, acronym for "Virtual Private Network"). This network is referred to as virtual because it connects two physical networks through a not necessarily reliable communication medium, and private because only the computers of the networks of either side of the virtual private network can access the data. Moreover, it makes it possible to secure exchanges on the not necessarily reliable communication medium.

In this way, a secured link at lower cost is created.

Figure 3:
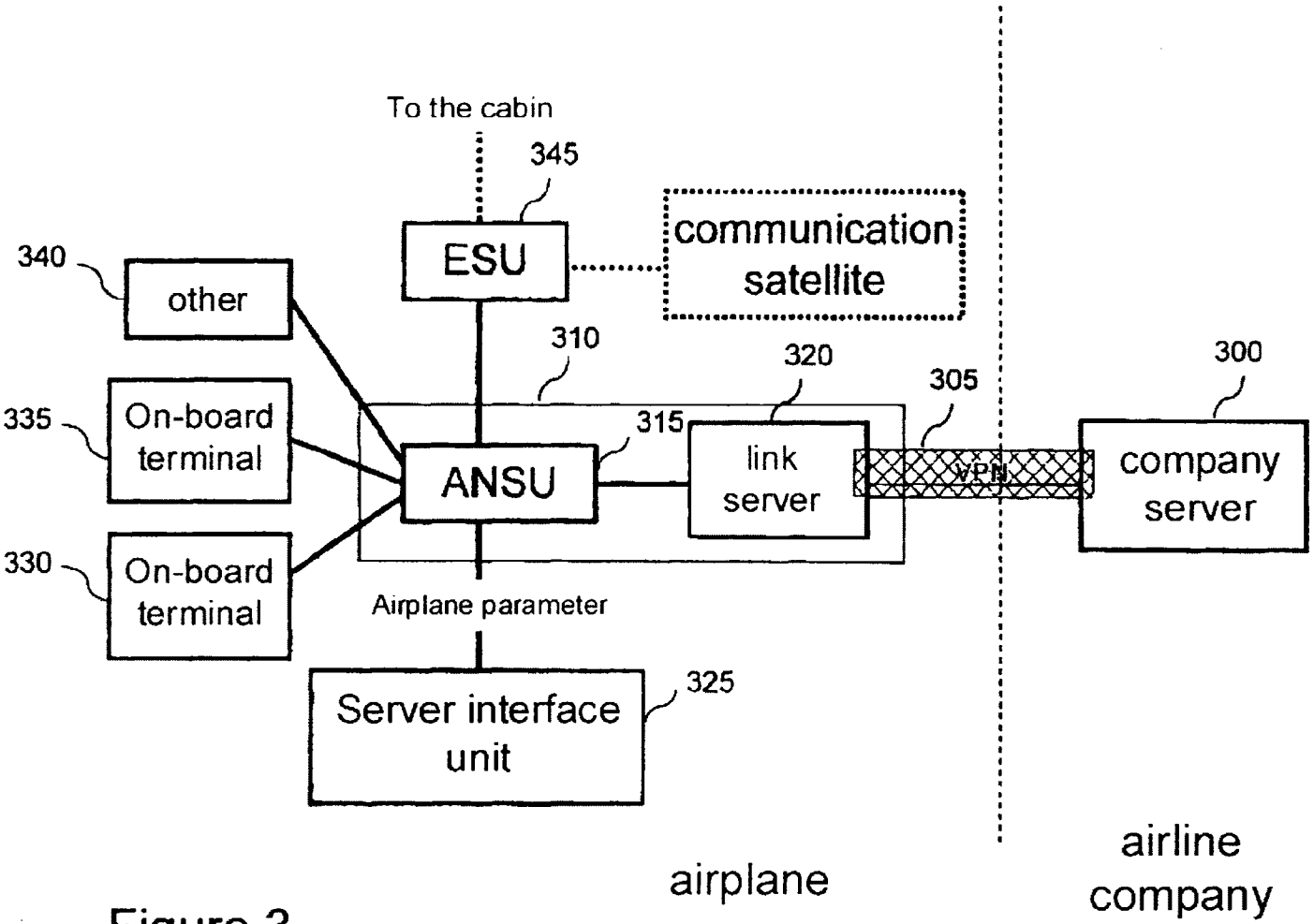
FIG. 3 illustrates a possible implementation in the on-board infrastructure for connection with the infrastructure on the ground according to the invention.

A possible implementation of this system in accordance with the invention is illustrated in FIG. 3.

According to this implementation, a server outside airplane 300, here on the ground, of the airline company, is connected to a link server 320 of the on-board structure of the airplane via a virtual network 305. The airplane server 310 comprises a network server ANSU ("Aircraft Network Server Unit" according to English terminology) 315 also connected to link server 320.

To the server ANSU 315, there are connected in particular a server interface unit 325, different on-board terminals 330, 335, 340 by means of an electronic network routing unit ("Ethernet Switch Unit" according to English terminology) 345.

According to a particular embodiment of the invention, the electronic storage unit is connected to a Satcom-type satellite network, the latter itself being capable of being connected to the server of the airline company.

The link server 320 is capable of being connected via a connection network, for example a virtual private network, to a server 300 of the airline company by using different communication mediums, in particular the mobile telephony network, for example the GSM ("Global System for Mobile Communications" according to English terminology)/EDGE/UMTS ("Universal Mobile Telecommunications System" in English terminology)/HSDPA ("High Speed Downlink Packet Access" in English terminology) network, or a wireless network, for example the WIFI 802.11 a/b/g or a satellite network, for example the HSD ("high speed data Satcom" in English terminology) network.

In that way, the computer network of the airplane is connected to the computer network on the ground, of the airline company to which the airplane is attached.

At the time of establishment of a network connection between the computer network of the airplane and the computer network on the ground, a medium is selected from among the plurality of available communication mediums, in particular according to the availability of the communication mediums or the output of the communication mediums.

The servers 300 and 330 then encapsulate and decapsulate the data via coding and encryption mechanisms.

These communication mediums are capable of providing a high output so as to allow the transmission of large masses of data between the infrastructure on the ground and the on-board infrastructure of the airplane in a reasonable time, and in particular to make it possible to load, from the airline company infrastructure on the ground to the airplane computers, the most recent versions of the tools, data and documents, the loading operation being able to be commanded by a technician on board the airplane or by a technician on the ground from the infrastructure on the ground.

Also, it is possible for a maintenance technician on board the airplane to have access to the maintenance data and the central tools for management of the information of the airline company ("maintenance information server" in English terminology or "Flight Ops Information server") stored in the infrastructure on the ground.

Furthermore, this type of connection makes it possible, by virtue of the Internet connections, to reach from the airplane servers connected to the airline company infrastructure on the ground, such as the server of the manufacturer of the airplane or of certain major items of equipment making up the airplane or its cabin.

Furthermore, according to this architecture, it is possible for a maintenance technician on board the airplane to have access to providers in order, for example, to consult flight data or maintenance documentations or to connect with service companies on the ground that support the maintenance operations of the airplane.

By means of such an architecture, the maintenance of an airplane, consisting in putting in working order, maintaining an airplane in good flying condition and repairing an airplane is carried out in the shortest possible time and in optimized manner, since all the tools on the ground for maintenance of the airplane are updated in particular at the moment of the authorization to dispatch the airplane.

Furthermore, in accordance with the invention, electronic maintenance makes it possible to put in working order and maintain an airplane in good flying condition at any moment and irrespective of its location.

To do so, a minimum of information data, such as the diagnosis tool, the electronic logbook, the list of minimum equipment MEL ("Minimum Equipment List" in English terminology), or even a subset of these data is loaded into the airplane.

Then, through the intermediary of the communication network 220, the maintenance technician on board the airplane will access by a connection called remote ("remote access" in English terminology), in particular secured, for example data present in the company infrastructure on the ground, such as the repair manual TSM, the maintenance manual AMM (acronym for "Aircraft Maintenance Manual" in English terminology) or the IPC (acronym for "Identification Part Catalogue" in English terminology) that makes it possible to identify the reference of a part to be replaced and to order it from the spares warehouse.

Figure 4:
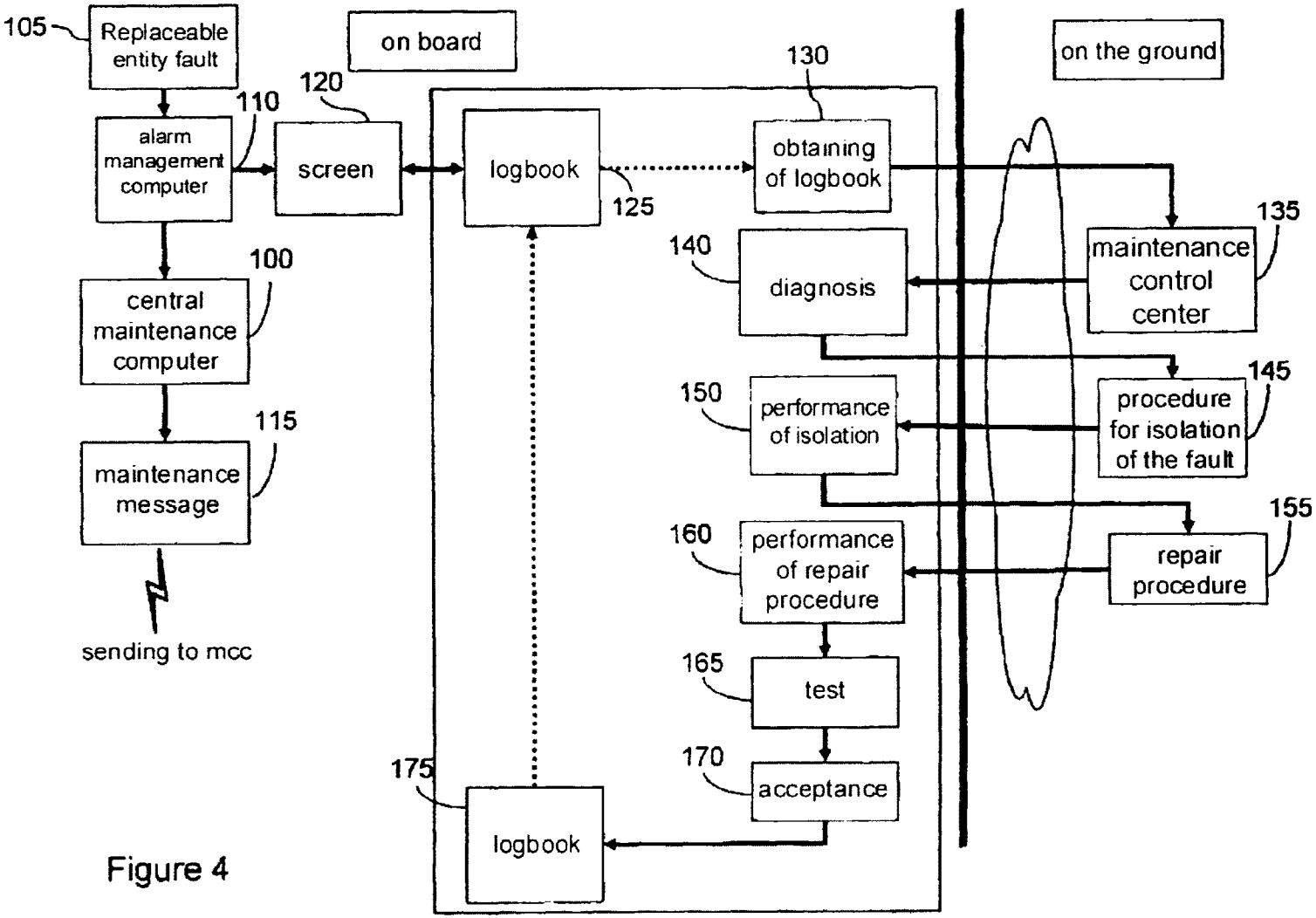
FIG. 4 illustrates maintenance operations performed in the airplane and in the maintenance base of the ground in accordance with the invention.

In that way, the technician has, via the communication network 220, in particular by the use of a VPN-type secured channel, an access to the manuals stored in the infrastructure on the ground, these manuals being the most recent versions, such as illustrated in FIG. 4, in that way limiting the maintenance technician's back-and-forth between the airplane and the maintenance infrastructure on the ground.

Figure 1:
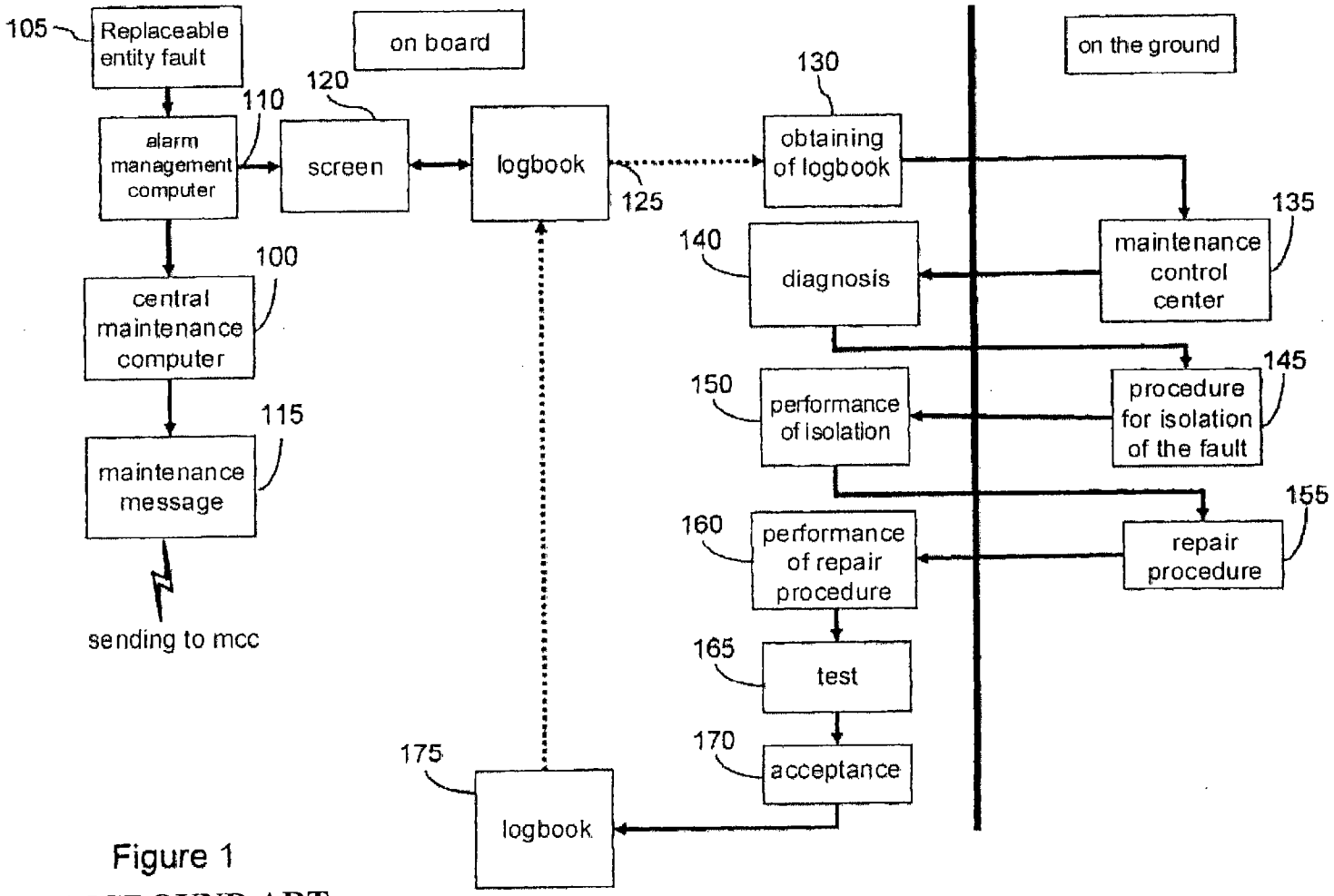
Figure 1 BACKGROUND ART
FIG. 1 illustrates maintenance operations performed in the airplane and in the maintenance base on the ground according to the state of the art.

In this way, such as illustrated in FIG. 4, where the references already cited on FIG. 1 appear again, the technician on board the airplane, by means of remote commands, in particular consultation commands, will access the procedure for isolation of the diagnosed fault, also called malfunction, 145, as well as the procedure for repair of the isolated fault 155 and if need be the spare parts warehouse, via the communication medium 220.

According to a particular embodiment, this network connection is a synchronous connection.

According to another embodiment, a technician on the ground can, prior to the arrival of the airplane on the ground, send out commands, via the communication network 220, to the on-board infrastructure in order to conduct a certain number of tests so as to diagnose, isolate and repair the faults as quickly as possible.

According to an embodiment, the tools, in particular the diagnosis tools, and the data can be loaded into the on-board infrastructure in the airplane, via the communication network 220, the latter being capable of carrying out exchanges between the on-board infrastructure and the infrastructure on the ground according to a high-output means of communication.

To do so, there can be put in place a communication network 220 capable of communicating between the link server 320 and the company server 300 according to a mobile telephony system and/or according to a wireless communication network, in particular by the use of a secured VPN-type channel.

According to an exemplary scenario, one is informed of a fault in an item of equipment by virtue of the storage of the fault in the logbook (logbook). An operator on the ground is connected to the airplane from the maintenance center (mcc) on the ground.

Since the result of the test concludes that the fault in the item of equipment is, for example, a "spurious message" (extraneous message), the operator, from his office, can decide that the item of equipment is operational, and issue an "OK" status on board the airplane (updating of the on-board database) at the same time that he updates the ground database.

Figure 5:
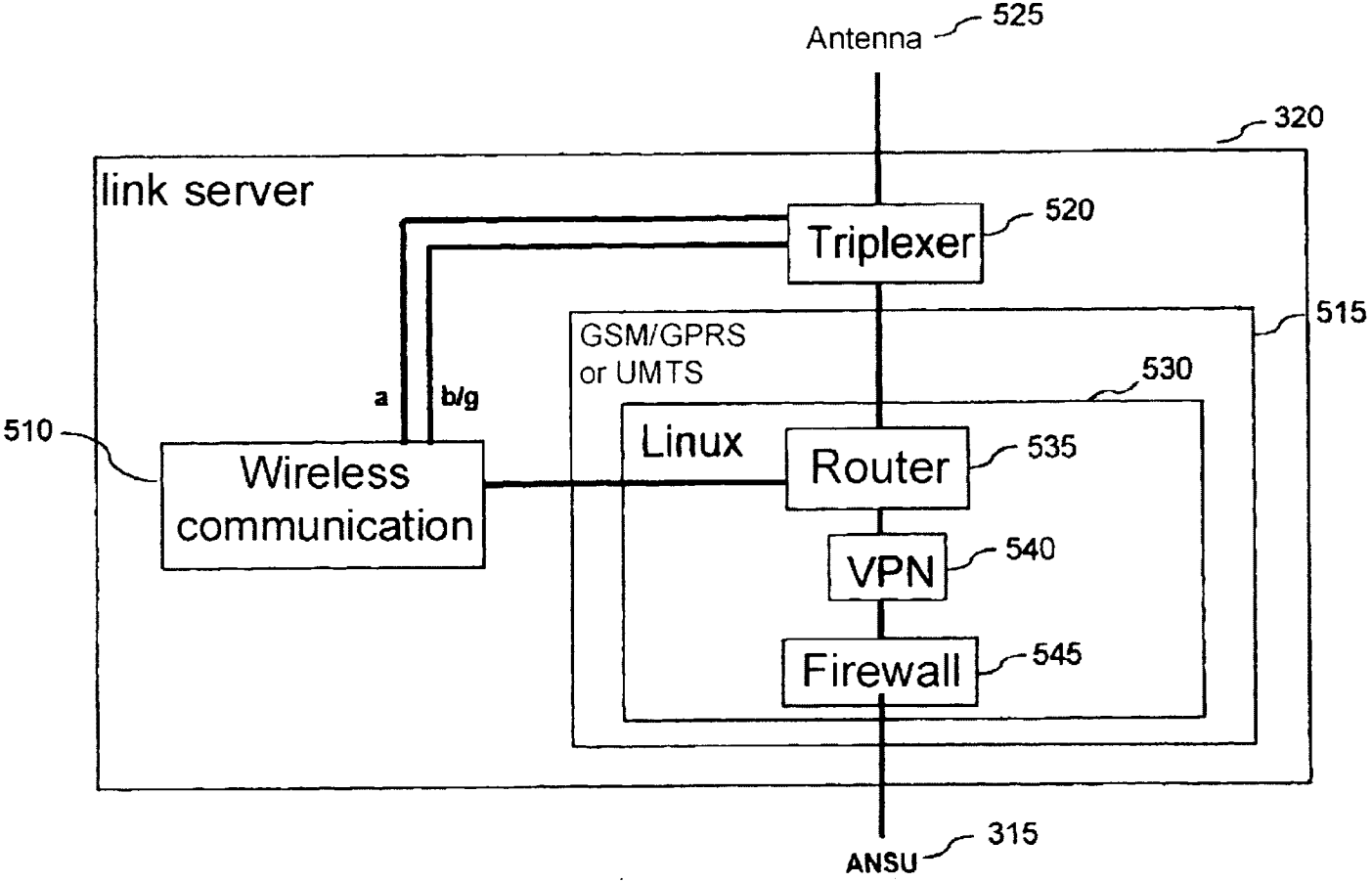
FIG. 5 shows an implementation of a link server in an airplane in accordance with the invention.

There now is illustrated in FIG. 5 an architecture for implementing the link server 320 in the airplane capable of communicating according to a mobile telephony network and according to a wireless communication network.

The link server 320 comprises a wireless communication module TWLU 510 ("Terminal Wireless LAN Unit" according to English terminology) capable of communicating, for example, according to the WIFI a/b/g or WImax standards, and a mobile telephony module 515 such as a GSM/GPRS or UMTS module, these two modules being connected to a triplexer module 520 connected to an antenna 525.

On the mobile telephony module 515, there is installed an operating system 530, on which there is present a router 535 capable of routing the communication either to the wireless communication module TWLU 510 or to the triplexer module 520 directly so as to use the mobile telephony protocol.

The communication of the server of the airplane with the server of the airline company is managed by a module VPN 540.

Furthermore, a fireguard ("firewall" according to English terminology) module 545 is installed upstream from the module VPN 540, between the data originating from the network server ANSU 315 and the module VPN 540 so as to protect the server 315 from intrusions.

Figure 6:
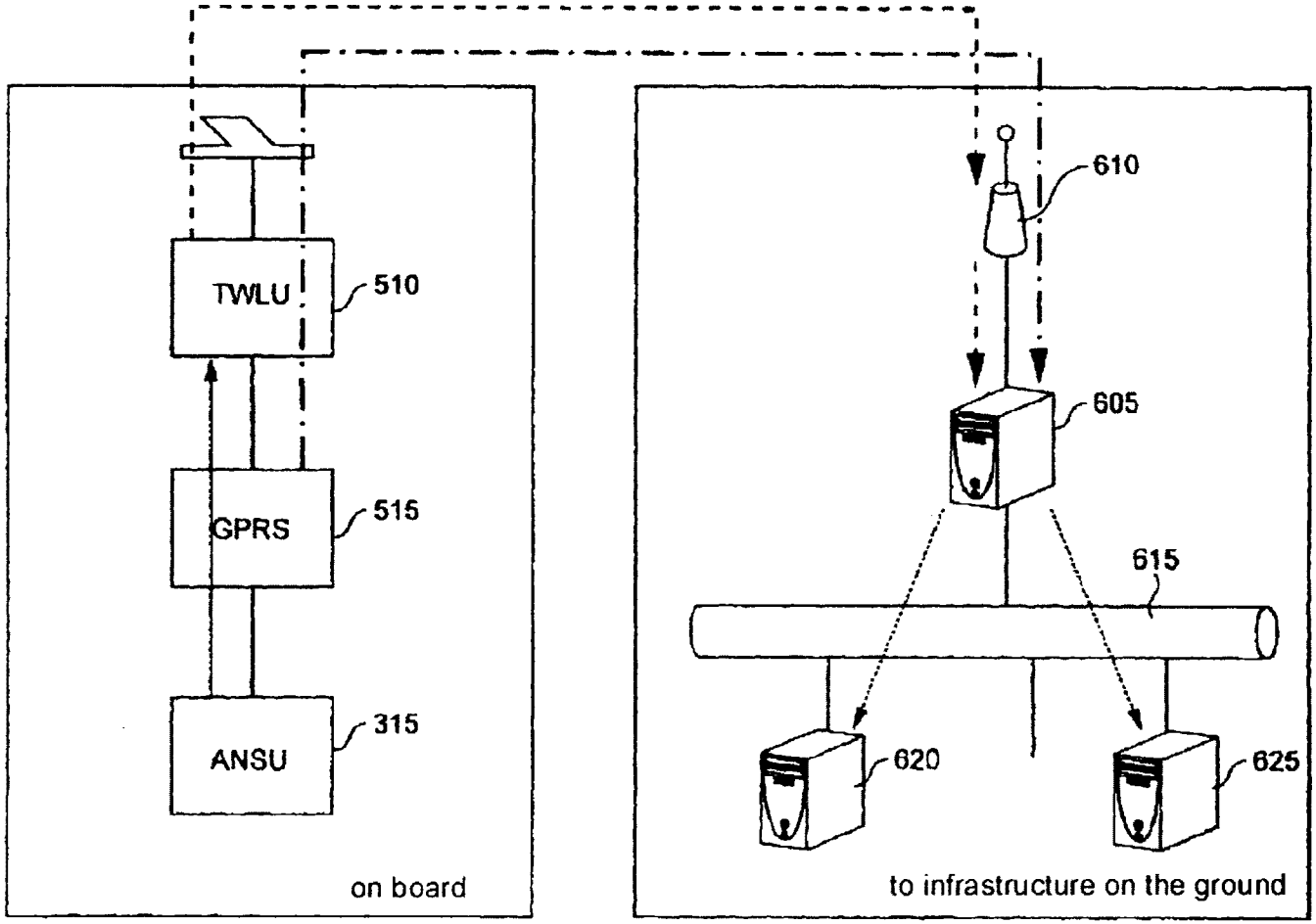
FIG. 6 illustrates an embodiment of the establishment of a virtual private network according to the invention.

FIG. 6 illustrates a method of establishing communication between a computer network forming at least in part the on-board infrastructure of an airplane and the computer network forming at least in part the airline company infrastructure on the ground, in accordance with the invention, based on the architecture shown in FIG. 5 comprising a wireless communication and a mobile telephony communication.

Within the airplane, such as seen above, a server ANSU 315 and a link server 320 comprising, according to the example, a wireless communication module TWLU 510 and a mobile telephony module 515, are present in the airplane.

Concerning the airline company network with which the server 310 of the airplane will communicate, this comprises a serveur proxy 605 (French translation of "proxy server", also called "agent server") of RADIUS ("Remote Authentication Dial-In User Service" according to English terminology) type, capable of receiving and sending out requests and data via an antenna 610.

The proxy server is a machine serving as intermediary between the computers of a local network of the airline company and a second network, the computer network of the airplane.

The proxy server 605 is connected via a local network 615 to other RADIUS servers 620, 625. In fact, it is to be noted that the RADIUS server can function as a proxy, that is, transmit requests from the client to other RADIUS servers.

A RADIUS server makes it possible to produce the link between identification needs and a user base ensuring transport of the authentication data in standardized manner.

In order to carry out data exchanges between the server of the airplane and the local network of the airline company, the server ANSU 315 generates an airplane certificate and transmits it to the wireless communication module 510 via the mobile telephony module 515 such as seen above.

The wireless communication module 510 sends out a request to the local network of the airline company according to the EAP—TLS ("Extensible Authentication Protocol—Transport Layer Security" according to English terminology) protocol, in order to exchange certificates and in this way create a secured tunnel between the network of the airplane and the local network of the airline company. This network created in this way is a virtual private network.

To do so, the EAP—TLS protocol uses two certificates for the creation of a secured tunnel which then allows identification: a server side and a client side.

This protocol uses an infrastructure with public keys ("Public Key Infrastructure" in English terminology) in order to secure the identification communications between the clients, namely the servers of the airplanes of the airline company and the RADIUS servers of the airline company.

The identification then is carried out, in particular by the sending out of a DHCP-type ("Dynamic Host Configuration Protocol" according to English terminology) request, to the proxy server of the local network of the airline company 305 in order to inform it of the identity thereof.

Figure 7:
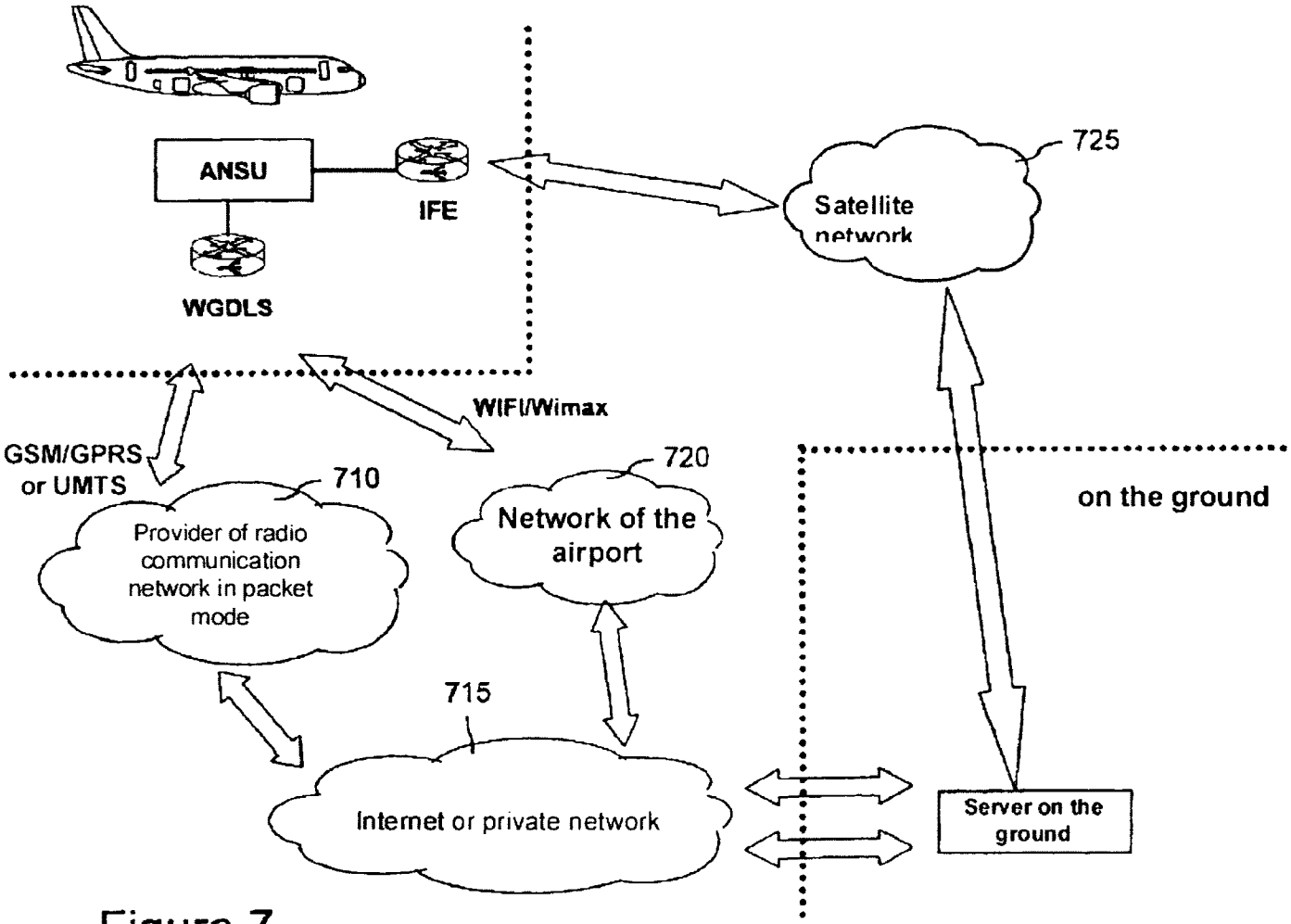
FIG. 7 illustrates different virtual private networks between a server of an airplane and a server on the ground in accordance with the invention.

FIG. 7 illustrates different virtual private networks capable of being created between the computer network of an airplane and the computer network on the ground, in particular the network of the airline company.

According to this Figure, there is illustrated the creation of a virtual private network based on a mobile telephony communication medium, namely the GSM/GPRS or UMTS network. Any type of mobile telephony network, however, can be used as a communication medium with a virtual private network according to the invention.

This type of virtual private network allowing communication of a computer network of an airplane with a network on the ground is achieved in particular via a provider of a radio communication network in packet mode 710 and the Internet network or a local private network 715.

Furthermore, there is illustrated the creation of a virtual private network based on a wireless communication medium 720, namely, for example, the WIFI or WImax network, the latter being in particular the network of the airport. This virtual private network also is achieved via the Internet network or a local private network 715.

Moreover, a virtual private network can be created between a computer network of an airplane and a network on the ground when the airplane is in flight, in particular by using a satellite communication 725.

Once this virtual private network exists, operations of maintenance, of loading, can be performed by a technician on board or on the ground and benefit from the most recent versions of the procedures manuals stored in the infrastructure on the ground.

Furthermore, it is possible to update the tools and data stores by the computers of the airplane in secured manner.

The invention claimed is:

1. A method for maintenance in an aircraft, the aircraft including an avionic system, the avionic system including a set of functional entities, wherein the avionic system is connected to an infrastructure on the ground according to at least one communication medium, the method comprising:

receiving, at the aircraft, a command to initiate at the aircraft testing of at least one functional entity of the set of functional entities via the at least one communication medium, the command being from the infrastructure on the ground;

testing, by a system of the aircraft, the at least one functional entity responsive to said receiving the command, said testing resulting in a diagnosis of a malfunction of the tested at least one functional entity of the set of functional entities;

consulting and obtaining, at the aircraft, via the at least one communication medium, maintenance data stored in the infrastructure on the ground relating to the malfunction of the tested at least one functional entity of the set of functional entities, the maintenance data including data regarding a procedure to repair the tested at least one functional entity; and repairing, at the aircraft, the tested at least one functional entity based on the obtained maintenance data which includes the data regarding the procedure to repair the tested at least one functional entity.

2. The method for maintenance according to claim 1, further comprising:

sending out at least one information item concerning the malfunction of the tested at least one functional entity to the infrastructure on the ground.

3. The method for maintenance according to claim 1, further comprising:

diagnosing the malfunction of the tested at least one functional entity; and isolating the malfunction based on the maintenance data obtained.

4. The method for maintenance according to claim 1, wherein the diagnosis of the malfunction of the tested at least one function entity of the set of functional entities indicates that the malfunction is spurious, and wherein the method further comprises receiving, at the aircraft, a status update to the tested at least one functional entity of the set of functional entities indicating that the at least one functional entity of the set of functional entities is not malfunctioning.

5. The method for maintenance according to claim 1, wherein the avionic system communicates with the infrastructure on the ground according to a synchronous communication mode.

6. A device for maintenance in an aircraft, the aircraft including an avionic system, the avionic system including a set of functional entities, wherein the avionic system is connected to an infrastructure on the ground according to at least one communication medium, the device comprising:

circuitry, in the aircraft, configured to receive, at the aircraft, a command to initiate at the aircraft testing of at least one functional entity of the set of functional entities via the at least one communication medium, the command being from the infrastructure on the ground;

test the at least one functional entity responsive to said receiving the command, the testing resulting in a diagnosis of a malfunction of the tested at least one functional entity of the set of functional entities;

consult and obtain, at the aircraft, via the at least one communication medium, maintenance data stored in the infrastructure on the ground relating to the malfunction of the tested at least one functional entity of the set of functional entities, the maintenance data including data regarding a procedure to repair the tested at least one functional entity; and repair, at the aircraft, the tested at least one functional entity based on the obtained maintenance data which includes the data regarding the procedure to repair the tested at least one functional entity.

7. The device for maintenance according to claim 6, wherein the circuitry is further configured to:

send at least one information item concerning the malfunction of the tested at least one functional entity to the infrastructure on the ground.

8. A non-transitory computer readable medium storing executable instructions which when executed by a processor perform a method for maintenance in an aircraft, the aircraft including an avionic system, the avionic system including a set of functional entities, wherein the avionic system is connected to an infrastructure on the ground according to at least one communication medium, the method comprising:

receiving, at the aircraft, a command to initiate at the aircraft testing of at least one functional entity of the set of functional entities via the at least one communication medium, the command being from the infrastructure on the ground;

testing, by a system of the aircraft, the at least one functional entity responsive to said receiving the command, said testing resulting in a diagnosis of a malfunction of the tested at least one functional entity of the set of functional entities;

consulting and obtaining, at the aircraft, via the at least one communication medium, maintenance data stored in the infrastructure on the ground relating to the malfunction of the tested at least one functional entity of the set of functional entities, the maintenance data including data regarding a procedure to repair the tested at least one functional entity; and repairing, at the aircraft, the tested at least one functional entity based on the obtained maintenance data which includes the data regarding the procedure to repair the tested at least one functional entity.

9. The method for maintenance according to claim 1, further comprising:

communicating by the aircraft with the infrastructure on the ground using a terminal wireless local area network (LAN) unit and a mobile telephone module.

10. The method for maintenance according to claim 9, wherein the terminal wireless LAN unit and the mobile telephone module are connected to a triplexer module, and the triplexer module is connected to an antenna.

11. The method for maintenance according to claim 9, wherein the terminal wireless LAN unit sends out a request to a local network of the airline company according to Extensible Authentication Protocol—Transport Layer Security protocol, in order to exchange certificates and create a secured tunnel between the network of the aircraft and the local network of the airline company.

12. The method for maintenance according to claim 5, wherein the synchronous communication mode includes establishing a communication link between the avionic system and the infrastructure on the ground, dedicated to communication between the avionic system and the infrastructure on the ground.

13. The method for maintenance according to claim 1, further comprising interactively browsing, using an onboard terminal, airline documentation stored on the infrastructure on the ground.

14. The method for maintenance according to claim 5, wherein the synchronous communication mode includes establishing a communication link between the avionic system and the infrastructure on the ground, dedicated to communication between the avionic system and the infrastructure on the ground, and wherein the communication link between the avionic system and the infrastructure on the ground is available for consulting data in the infrastructure on the ground from the aircraft and for obtaining information items stored in the infrastructure on the ground.

15. The method for maintenance according to claim 1, wherein said receiving the command is performed when the aircraft is in the air, prior to the aircraft landing.

16. The method for maintenance according to claim 15, wherein said testing, by the system of the aircraft, the at least one functional entity is performed when the aircraft is in the air, prior to the aircraft landing.

17. The method for maintenance according to claim 16, wherein said consulting and obtaining maintenance data are performed when the aircraft is in the air, prior to the aircraft landing.

18. The device for maintenance according to claim 6, wherein the command is received when the aircraft is in the air, prior to the aircraft landing.

19. The device for maintenance according to claim 18, wherein said testing of the at least one functional entity is performed when the aircraft is in the air, prior to the aircraft landing, and wherein the maintenance data is consulted and obtained when the aircraft is in the air, prior to the aircraft landing.

20. The non-transitory computer readable medium according to claim 8, wherein said receiving the command is performed when the aircraft is in the air, prior to the aircraft landing, wherein said testing the at least one functional entity is performed when the aircraft is in the air, prior to the aircraft landing, and wherein said consulting and obtaining maintenance data are performed when the aircraft is in the air, prior to the aircraft landing.

21. The method for maintenance according to claim 1, wherein at least one information processing tool is shared between the infrastructure on the ground and the aircraft, the at least information processing tool being operative such that any maintenance operation and simultaneous updating of a database of the infrastructure on the ground and a database of the aircraft is performed synchronously, and such that verification of the databases is not necessary and is not performed.

* * * * *